US008752407B2

(12) United States Patent
Taiga

(10) Patent No.: US 8,752,407 B2
(45) Date of Patent: Jun. 17, 2014

(54) CABLE LOCK

(75) Inventor: Keiji Taiga, Tokyo (JP)

(73) Assignee: Crops Co., Ltd., Tokyo (JP)

( * ) Notice: Subject to any disclaimer, the term of this patent is extended or adjusted under 35 U.S.C. 154(b) by 385 days.

(21) Appl. No.: 13/200,388

(22) Filed: Sep. 23, 2011

(65) Prior Publication Data

US 2013/0074555 A1 Mar. 28, 2013

(51) Int. Cl.
*E05B 73/00* (2006.01)

(52) U.S. Cl.
USPC ..... 70/30; 70/52; 70/53; 70/304; 70/312; 70/321; 70/322; 70/386; 70/397; 70/299; 70/298

(58) Field of Classification Search
USPC ..... 70/386, 30, 53, 52, 301, 304, 312, 70/297–299, 321–322
See application file for complete search history.

(56) References Cited

U.S. PATENT DOCUMENTS 4,155,234 A * 5/1979 Bako ..... 70/312
4,462,232 A * 7/1984 Yang ..... 70/312
4,899,559 A * 2/1990 Chern ..... 70/25
5,904,056 A * 5/1999 Ozaki ..... 70/18
5,970,758 A * 10/1999 Chen ..... 70/209
6,053,017 A * 4/2000 Ling ..... 70/58
6,363,757 B1 * 4/2002 Yu ..... 70/28
6,470,717 B1 * 10/2002 Yu ..... 70/25
6,513,356 B1 * 2/2003 Yang ..... 70/213
7,367,207 B2 * 5/2008 Yang ..... 70/284
8,074,478 B1 * 12/2011 Shu ..... 70/58
8,505,342 B1 * 8/2013 Taiga ..... 70/14
2004/0089032 A1 * 5/2004 Ling ..... 70/30

* cited by examiner

*Primary Examiner* — Peter M Cuomo
*Assistant Examiner* — Ifeolu Adeboyejo
(74) *Attorney, Agent, or Firm* — Guice Patents PLLC

(57) ABSTRACT

The invention relates to a cable lock, which consists of a lock body combined with a traversing part, wherein a slider and a holder are set inside the lock body, at least an upper bead hole is set on the slider, the at least an upper bead hole is set corresponding to at least a lower bead hole set on the holder, the upper bead hole and the lower bead hole may be glided and corresponding to each other by shifting the slider, to control at least a lock ball gliding in and out, hereby perform unlocking and locking spacing on an inserting slice set on one end of the traversing part, to thereby achieve the burglarproof and prized-proof effect.

8 Claims, 9 Drawing Sheets

CABLE LOCK

BACKGROUND OF THE INVENTION

1. Field of the Invention

The invention relates to a cable lock, and, more particularly, to a cable lock with strengthened and prized-proof structure, to thereby improve the burglarproof and prized-proof effect.

2. Description of Related Art

Please refer to FIG. 1, which shows a combination lock 1 combined with a traversing part 13, wherein the traversing part 13 is used to traverse and encircle around an object for convenient burglarproofing and locking. The combination lock is suitable for bicycles and traveling bags to lock for burglarproofing. The structure of the combination lock 1 is mainly used a slider 12 wedging a number wheel 11 for controlling locking and unlocking motion of the combination lock 1. Since the structure is very simple, it is easy for thieves to prize by using tools and causes property damage of owners. Thus, improvements of structure for various combination locks are submitted for strengthen the burglarproof effect. However, most of the modifications concentrate on the structure of number wheel, not on the components for preventing of prized. Thus, as a result, theft still happens anywhere and there is no feasible and effective solution.

SUMMARY OF THE INVENTION

Respecting the defects of the prior art, after numberless modifications, the inventor finally completed the prized-proof structure of a cable lock according to the present invention. Namely, the object of the invention is to provide a cable lock with a strengthened and prized-proof structure, to thereby improve the burglarproof and prized-proof effect.

To achieve the object, the cable lock of the invention consists of a lock body combined with a traversing part, wherein a slider and a holder are set inside the lock body, at least an upper bead hole is set on the slider, the at least an upper bead hole is set corresponding to at least a lower bead hole set on the holder, the upper bead hole and the lower bead hole may be glided and corresponding to each other by shifting the slider, to control at least a lock ball gliding in and out, hereby perform unlocking and locking spacing on an inserting slice set on one end of the traversing part, to thereby achieve the burglarproof and prized-proof effect.

The above traversing part of the invention is a steel rope (or a chain, a metal cord), to conveniently traverse and encircle around the object to be locked (such as bicycle, traveling bags) with the pliable property.

The above lock body of the invention at least includes:

an upper housing, a crosswise guide rib is set on the center of its inner surface, at least one number wheel display part is set on at least one of two outer surfaces of the upper housing, multiple number display opening are set on the number wheel display part, and multiple locating holes are correspondingly set on the inner surface of the upper housing near the location of the multiple number display opening;

a lower housing, which is aligned to the upper housing, an inserting room is set on the inner surface of the lower housing, and multiple wheel body fixed legs are dispersively set near the location the inserting room for wrapping by multiple corresponding third springs and inserting fixed in the locating holes of the lower housing;

a slider, a spacing trough is set on the front side of the slider for the crosswise guide rib of the upper housing embedding in, a lateral spring containing trough is set on one side of the slider for containing a first spring propped up its one end, a groove is extended inward from another side of the bottom side of the slider, at least one upper bead hole is set through on the groove, and multiple cavities are set respectively on two sides of the slider corresponding to the number wheel display part, and an embed part is convexly set on the aperture fringe of the cavities;

a number wheel, which consists of multiple number wheels, multiple wheel seats and multiple pieces, the axis of the wheel seat is wrapped in the axle hole of the number wheel and positioned between the upper housing and the lower housing, and at least a clamping gap is set on the peripheral edge of the wheel seat for the embed part embedding in;

a holder, which is contained inside the inserting room of the lower housing, a inserting slot is concavely set on its bottom side, and at least a lower bead hole is set on the holder and corresponds to the at least an upper bead hole of the slider, the upper bead hole and the lower bead hole may be glided and corresponding to each other by shifting the slider;

at least a lock ball, the front end is a curved end, and a concave slot is set concavely on the back end for a second spring propping up;

the traversing part, a first joint part fixedly wrapped a joint is set on one end of its rope body, a second joint part fixedly wrapped a lock blade is set the other end of the traversing part, an inserting slice is set on the front end of the lock blade, and at least a embed slot is set on the inserting slice for the lock ball pushing to lock and unlock.

The above lock body of the present invention is wrapped in a protection stand.

The above upper housing of the present invention, a convex rib is convexly set on one end of the crosswise guide rib and at least a spring containing trough is set concavely on another end.

The above upper housing of the present invention, a connection fixed leg is set on one end of its inner surface, and multiple fixed legs are set in the corner of the inner surface.

The above lower housing of the present invention, a fixed hole is set on one end of the inner surface of the lower housing, and multiple joint holes are set on the inner surface.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE INVENTION

Figure 1:
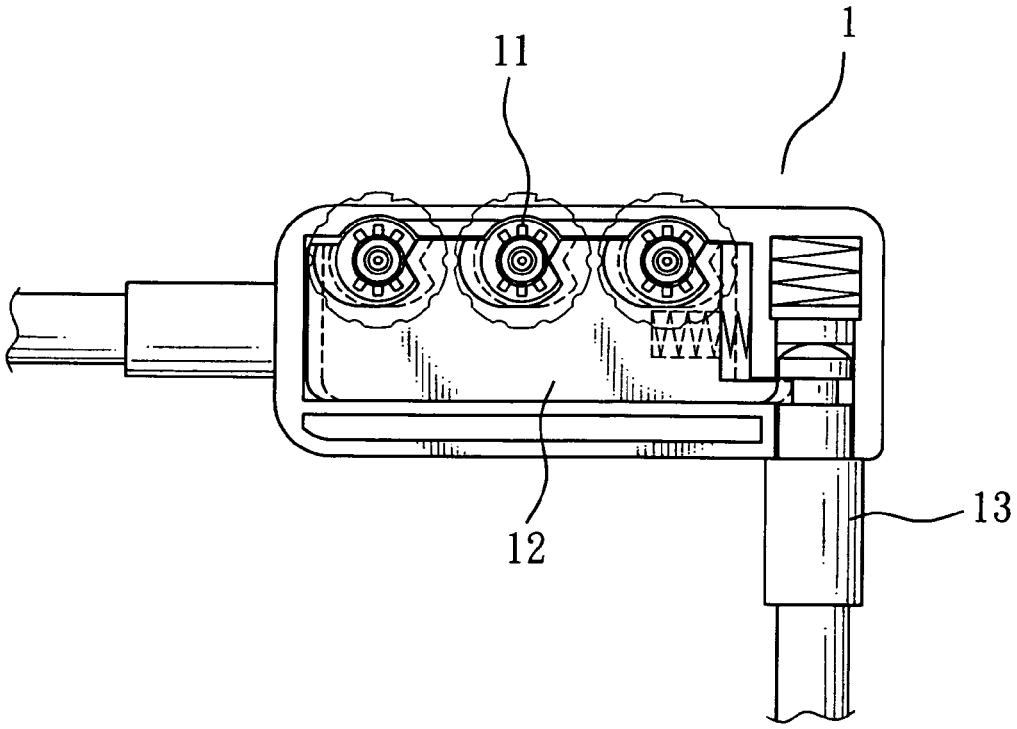
FIG. 1 PRIOR ART
FIG. 1 is a schematic diagram of a conventional combination lock.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

Figure 2:
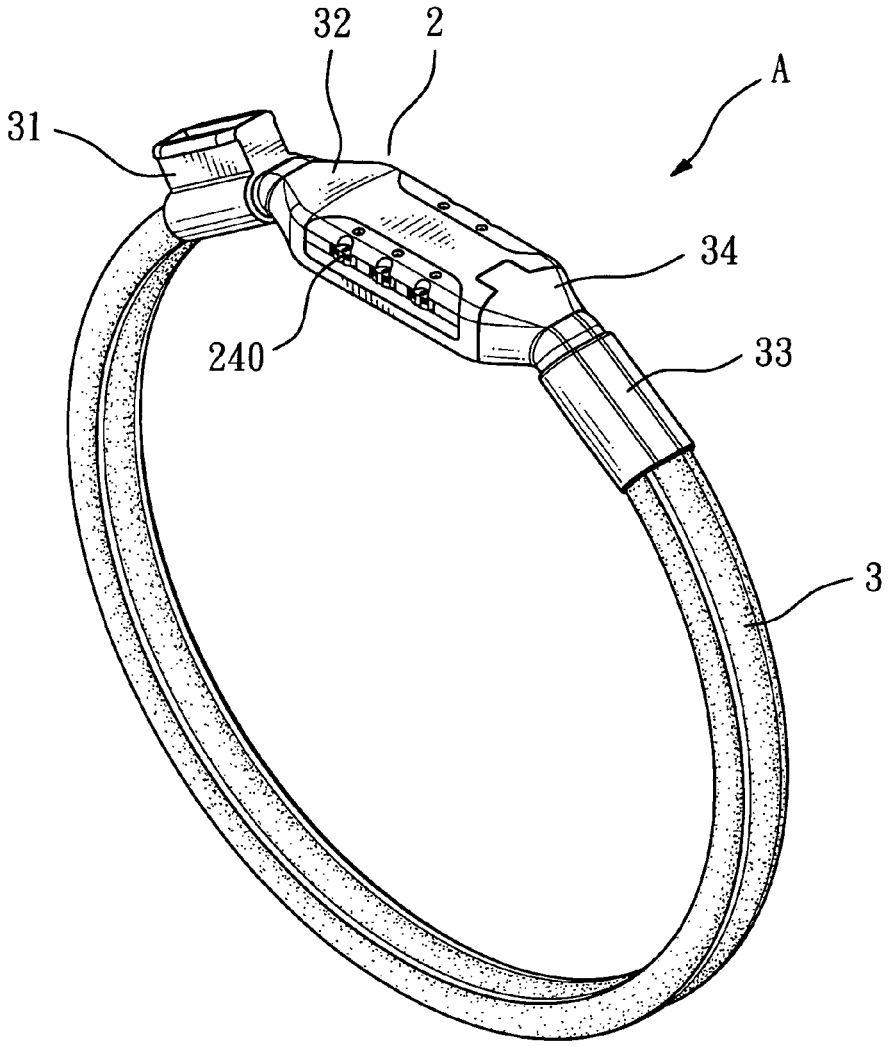
FIG. 2 is a three-dimension diagram of the present invention.
Figure 3:
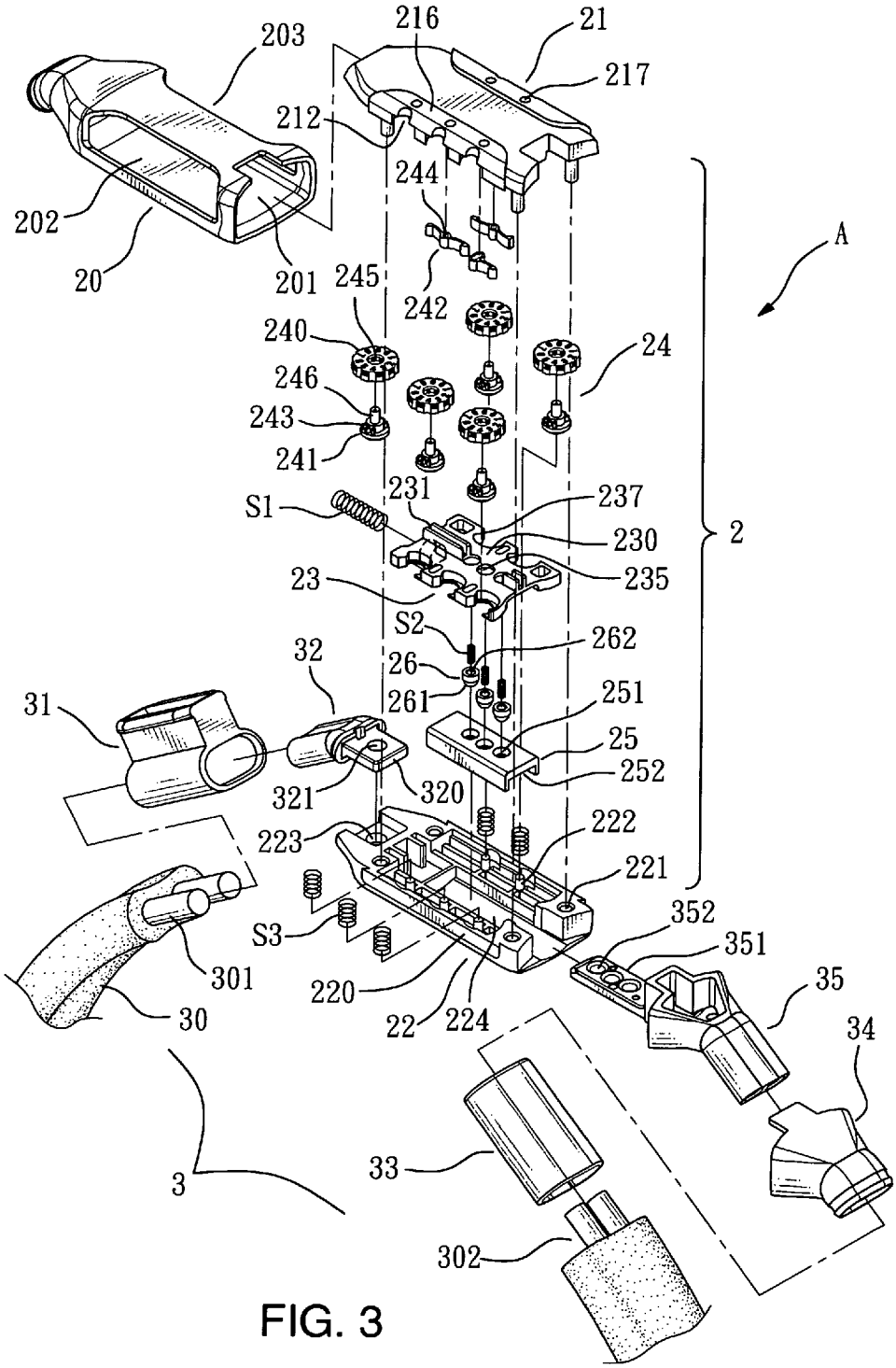
FIG. 3 is a three-dimension exploded diagram of the present invention.

Please refer to FIG. 2 and FIG. 3, the cable lock A of the present invention consists of a lock body 2 combined with a traversing part 3, wherein a protection stand 20 is wrapped outside the lock body 2, the protection stand 20 is a hollow stand with number wheel apertures 202, 203 set on at least one side of its front and back sides, and a lateral square opening 201 is set on one side of the protection stand 20 for the lock body 2 passing through and inserting.

Figure 4:
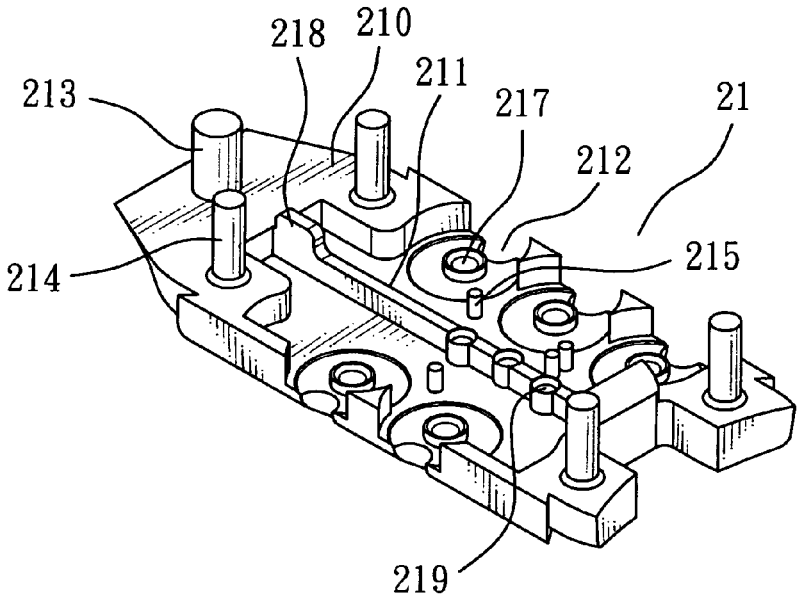
FIG. 4 is another three-dimension diagram of the upper housing of the present invention.
Figure 5:
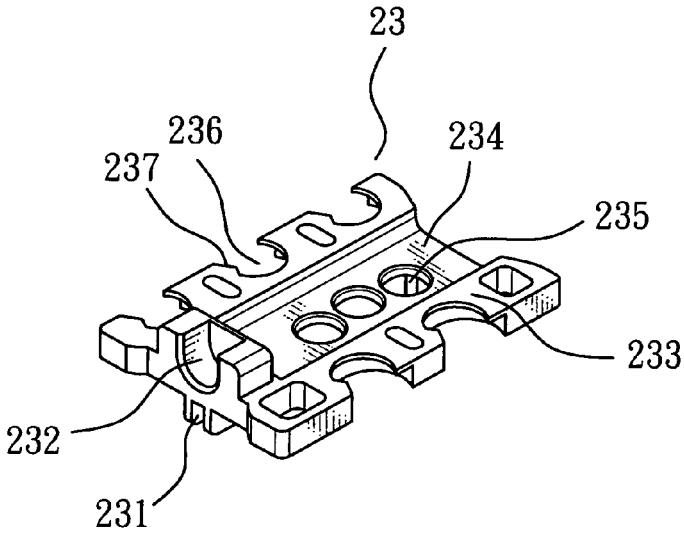
FIG. 5 is another three-dimension diagram of the slider of the present invention.

The abovementioned lock body 2 includes at least:

an upper housing 21, a crosswise guide rib 211 is set on the center of its inner surface 210 (as shown in FIG. 4), a convex rib 218 is convexly set on one end of the crosswise guide rib 211 and at least a spring containing trough 219 is set concavely on another end, at least a number wheel display part 216 is set on at least one of two outer surfaces of the upper housing 21, the number wheel display part 216 is set above the number wheel apertures 202, 203, multiple number display openings 212 are set on the number wheel display part 216, multiple locating holes 217 and multiple locating legs 215 are correspondingly set on the inner surface 210 of the upper housing 21 near the location of the multiple number display opening 212; a connection fixed leg 213 is set on one end of the inner surface 210 of the upper housing 21, and multiple fixed legs 214 are set in the corner of the inner surface 210;

a lower housing 22, which is aligned to the upper housing 21 and installed inside the protection stand 20, a fixed hole 223 is set on one end of the inner surface 220 of the lower housing 22 for the connection fixed leg 213 of the upper housing 21 fixedly inserting, and multiple joint holes 221 are further set in the peripheral corner of the inner surface 220 for the fixed legs 214 fixedly inserting, a inserting room 224 is set on the other end of the inner surface 220, and multiple wheel body fixed legs 222 are separately installed near the location of the inserting room 224 for the multiple corresponding third springs S3 wrapping and fixedly inserted in the locating hole 217;

a slider 23, a spacing trough 231 is set on its front side 230 for the crosswise guide rib 211 of the upper housing embedding in, and a lateral spring containing trough 232 is set on one side of the slider 23 (as shown in FIG. 5) for containing a first spring S1 propped up its one, a groove 234 is extended inward from another side of the bottom side 233 of the slider 23, at least one upper bead hole 235 is set through on the groove 234, multiple cavities 236 are set respectively on two sides of the slider 23 corresponding to the number wheel display part 216, and an embed part 237 is convexly set on the aperture fringe of the cavities 236;

a number wheel 24, which consists of multiple number wheels 240, multiple wheel seats 241 and multiple pieces 242, the axis 246 of the wheel seat 241 is wrapped in the axle hole 245 of the number wheel 240 and positioned between the locating holes 217 of the upper housing 21 and the wheel body fixed legs 222 of the lower housing 22, the wheel seat 241 is against the third spring S3, and at least a clamping gap 243 is set on the peripheral edge of the wheel seat 241 for the embed part 237 embedding in, and a axle hole 244 is set thoroughly on the slice body of the piece 242 for the locating leg 215 of the upper housing 21 wrapped, and the number wheel 240 is prevented for excessively rotating because of the damping limitation of the piece 242 for the number wheel 24;

a holder 25, which is contained inside the inserting room 224 of the lower housing 22, a inserting slot 252 is concavely set on its bottom side, and at least a lower bead hole 251 is set on the holder 25 and corresponds to the at least an upper bead hole 235 of the slider 23, the upper bead hole 235 and the lower bead hole 251 may be glided and corresponding to each other by shifting the slider 23;

at least a lock ball 26, the front end 261 is a curved end, and a concave slot 262 is set concavely on the back end for a second spring S2 propping up, and the other end of the second spring S2 is propped on the spring containing trough 219 of the upper housing 21;

the traversing part 3, a first joint part 301 fixedly wrapped a joint 32 is set on one end of its rope body 30 and fixedly wrapped a joint seat 31 near the first joint part 301, the joint 32 has a joint board 320, a fixed hole 321 is set on the joint board 320 for a connection fixed leg 213 of the upper housing 21 passing through to fix, and a second joint part 302 fixedly wrapped a lock blade 35 is set the other end of the traversing part 3, a joint cover 34 and a jacket 33 are set outside the first joint part 301, and an inserting slice 351 is set on the front end of the lock blade 35, and at least a embed slot 352 is set on the inserting slice 351 for the lock ball 26 pushing to lock and unlock.

Figure 6:
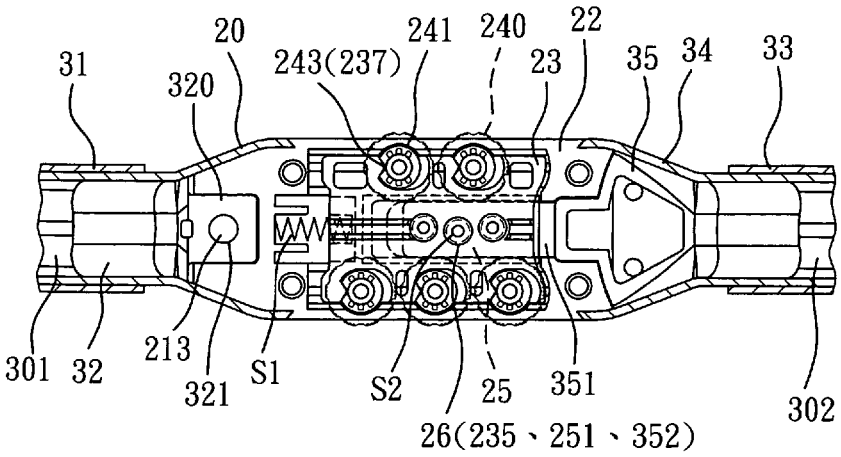
FIG. 6 is a diagram of the unlocking state (1) of the present invention.
Figure 8:
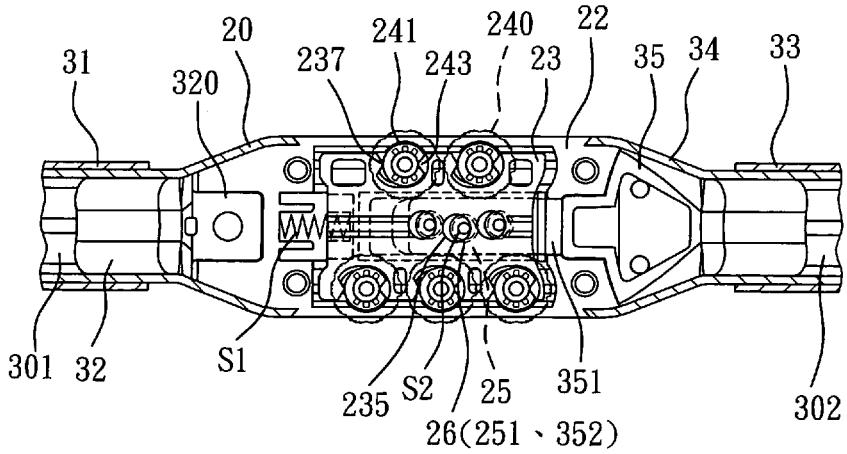
FIG. 8 is a diagram of the locking state (1) of the present invention.
Figure 7:
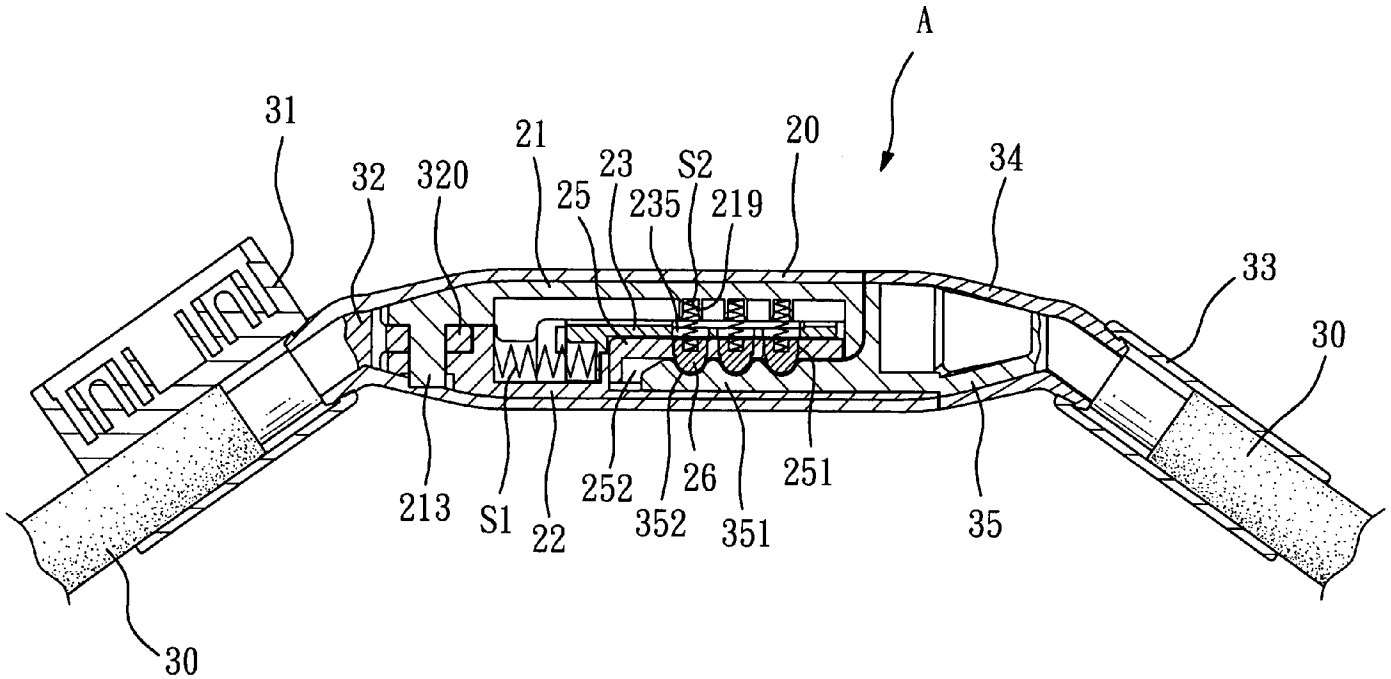
FIG. 7 is a diagram of the unlocking state (2) of the present invention.
Figure 9:
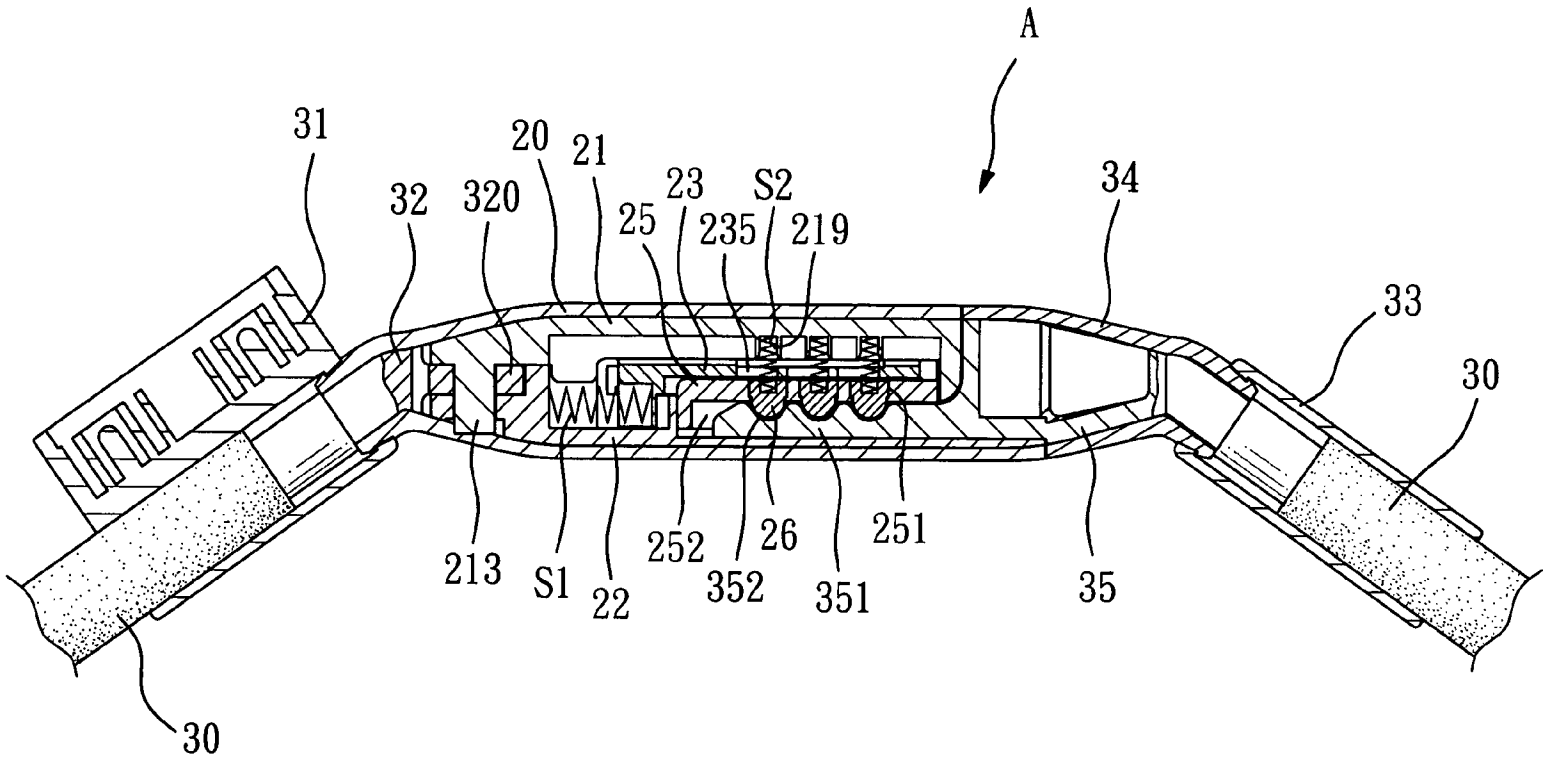
FIG. 9 is a diagram of the locking state (2) of the present invention.
Figure 10:
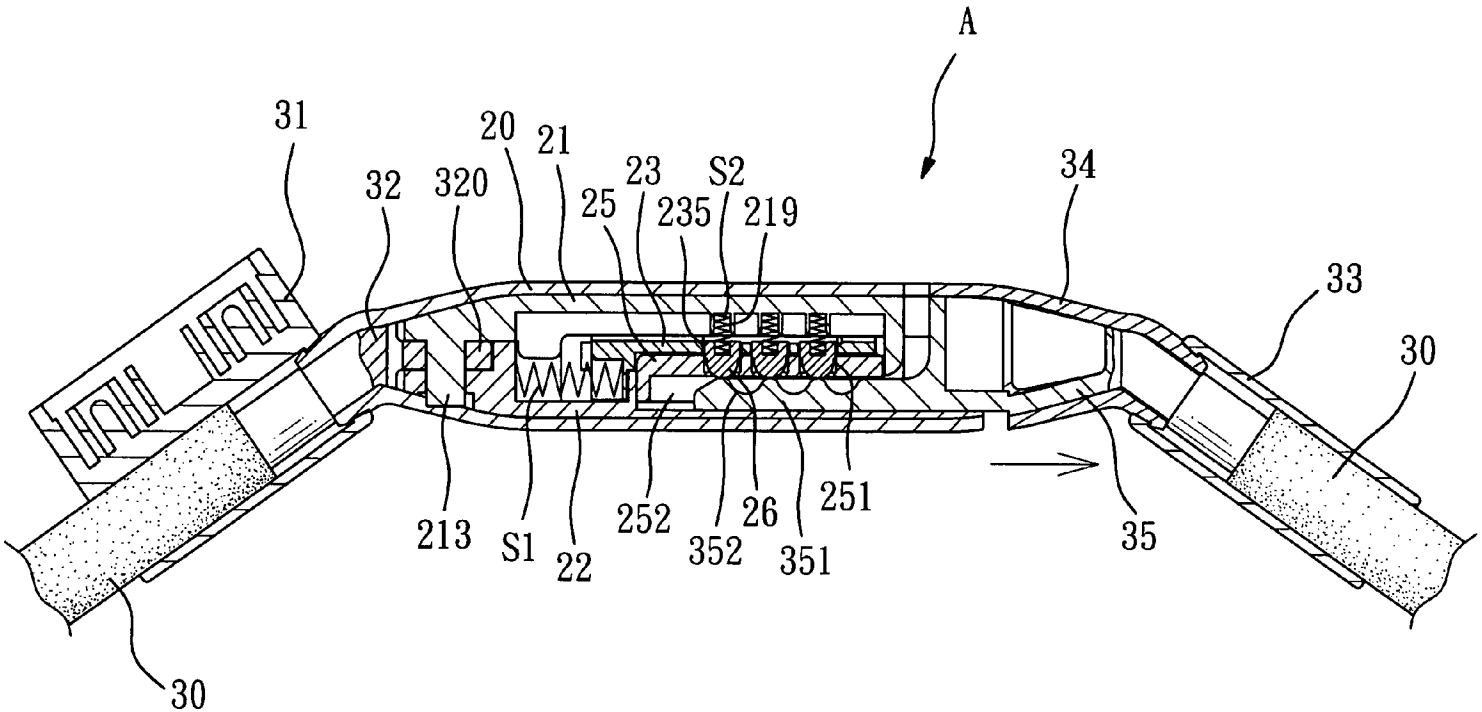
FIG. 10 is a diagram of the operation (1) of the present invention.
Figure 11:
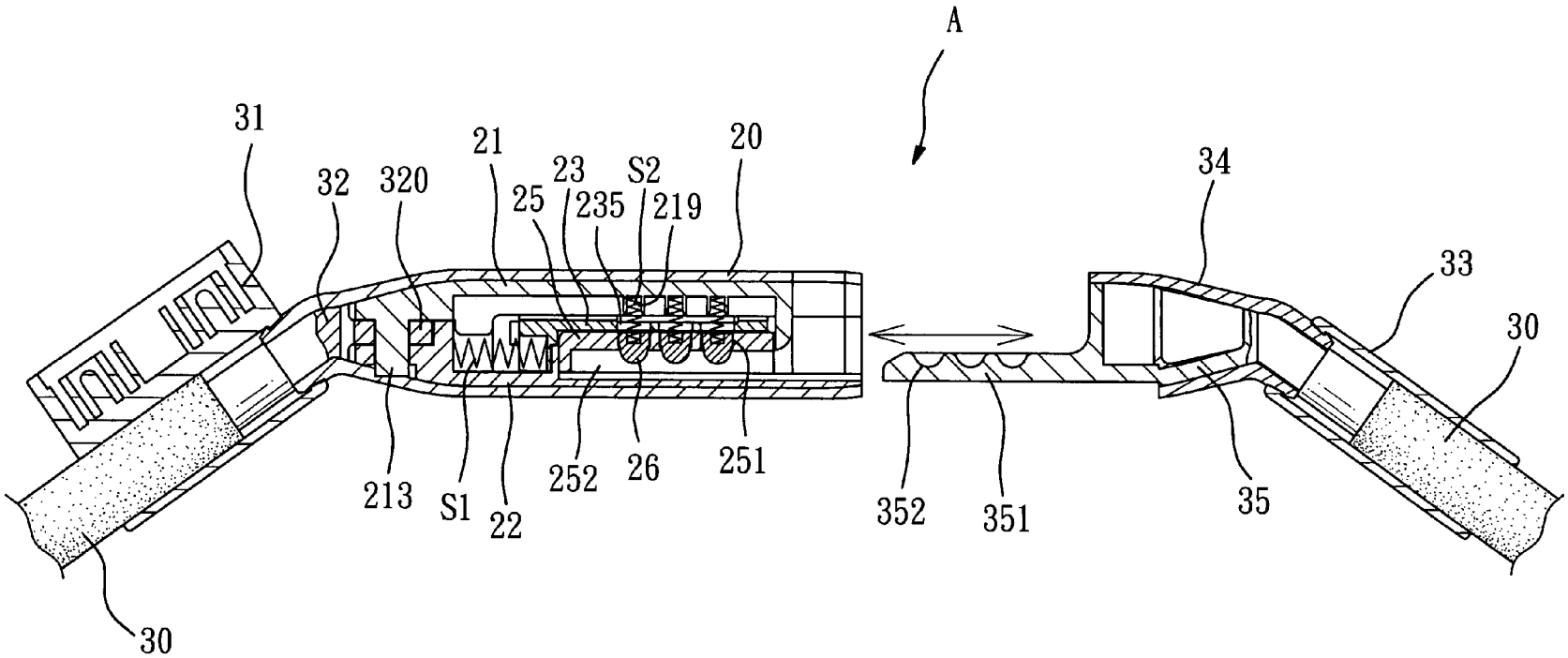
FIG. 11 is a diagram of the operation (2) of the present invention.

Please refer to FIG. 6 and FIG. 7, in the present invention, when unlocking, first turning round the number wheel 240 to the unlock number. When the number exactly aligns, the embed part 237 of the slider 23 is no longer embedded in the clamping gap 243, the slider 23 shifts because of the restitution force of the first spring S 1, and make the upper bead hole 235 aligns to the lower bead hole 251 and the embed slot 352, and the lock ball 26 may be glided up and down between them as an unlocking state, at this time, it only needs to extract the lock blade 35 away from the inserting slot 252 (as shown in FIG. 10 and FIG. 11), the unlocking operation is completed; and when locking, first turning round the number wheel 240 to the locking number, and inserting the inserting slice 351 of the lock blade 35 into the location of the inserting slot 252 (as shown in FIG. 8 and FIG. 9), at the time, turning round the number wheel 240 to a non-locking number, the embed part 237 may embed in the clamping gap 243 and make the slider 23 shifting to compress the first spring S 1, and then make the upper bead hole 235 and the lower bead hole 251 being not aligned, the lock ball 26 embeds in the embed slot 352 fixedly and forms the locking state.

I claim:

1. A cable lock comprising:

a lock body combined with a traversing part, wherein:

the lock body, which includes at least:

an upper housing, a crosswise guide rib is set on the center of its inner surface, at least one number wheel display part is set on at least one of two outer surfaces of the upper housing, multiple number display openings are set on the number wheel display part, and multiple locating holes are correspondingly set on the inner surface of the upper housing near the location of the multiple number display openings;

a lower housing, which is aligned to the upper housing, an inserting room is set on an inner surface of the lower housing, and multiple wheel body fixed legs are dispersively set near the location of the inserting room for wrapping by multiple corresponding third springs and fixedly inserted into the locating holes of the upper housing;

a slider, a spacing trough is set on a front side of the slider for the crosswise guide rib of the upper housing embedding in, a lateral spring containing trough is set on a first end of a bottom side of the slider, a first spring has one end located in the lateral spring containing trough, a groove is extended inward from a second end of the bottom side of the slider, at least one upper bead hole is located through the groove, and multiple cavities are set respectively on two sides of the slider corresponding to the number wheel display part, and an embed part is convexly set on an aperture fringe of the cavities;

a number wheel device having multiple number wheels, multiple wheel seats and multiple pieces, an axis of each wheel seat of the multiple wheel seats is inserted into an axle hole of a corresponding number wheel of the multiple number wheels and positioned between the upper housing and the lower housing, and at least one clamping gap is set on the peripheral edge of each wheel seat of the multiple wheel seats;

a holder located in the inserting room of the lower housing and having an inserting slot concavely set on a bottom side of the holder, and at least a lower bead hole is located in the holder and corresponds to the at least an upper bead hole of the slider, the upper bead hole and the lower bead hole are glidable and corresponding to each other by shifting the slider;

at least a lock pin, the front end is a curved end, and a concave slot is set concavely on the back end and a second spring is inserted therein;

a first joint part fixedly connected to a joint located on a first end of a rope body of the traversing part, a second joint part fixedly connected to a lock blade located on a second end of the rope body of the traversing part, an inserting slice is set on a front end of the lock blade, and at least a embed slot is set on the inserting slice and the lock pin is movable between a lock position and an unlocked position.

2. The cable lock as claimed in claim 1, wherein a protection stand is wrapped outside the lock body.

3. The cable lock as claimed in claim 1, wherein a convex rib is convexly set on one end of the crosswise guide rib and at least a spring containing trough is set concavely on another end.

4. The cable lock as claimed in claim 1, wherein a connection fixed leg is set on one end of the inner surface of the upper housing.

5. The cable lock as claimed in claim 1, wherein a fixed hole is set on a first end of the inner surface of the lower housing, and multiple joint holes are set on a second end the inner surface of the lower housing.

6. The cable lock as claimed in claim 1, wherein the traversing part is a steel rope.

7. The cable lock as claimed in claim 1, wherein the traversing part is a chain.

8. The cable lock as claimed in claim 1, wherein the traversing part is a metal cord.

* * * * *